US007104865B1

(12) United States Patent
Neuburger

(10) Patent No.: US 7,104,865 B1
(45) Date of Patent: Sep. 12, 2006

(54) APPARATUS FOR CAT'S CRADLE GAME

(76) Inventor: Michelle Neuburger, 24 Hitching Post Rd., Chappaqua, NY (US) 10514

( * ) Notice: Subject to any disclaimer, the term of this patent is extended or adjusted under 35 U.S.C. 154(b) by 0 days.

(21) Appl. No.: 10/906,479

(22) Filed: Feb. 22, 2005

(51) Int. Cl.
*A63H 33/00* (2006.01)
*A63H 3/20* (2006.01)
*A63H 11/00* (2006.01)

(52) U.S. Cl. ..... 446/331; 446/330; 446/490

(58) Field of Classification Search ..... 446/491, 446/331, 490; 414/1–7; 294/106, 111
See application file for complete search history.

(56) References Cited

U.S. PATENT DOCUMENTS 5,289,273 A * 2/1994 Lang ..... 348/121
5,647,723 A * 7/1997 Rush ..... 414/735

OTHER PUBLICATIONS

Budiato, et al., "A 3-D String Figure Dsplay System for Animating Cat's Cradle Game" Internet—http://ieeexplore.ieee.org/search/wrapper.jsp?arnumber=626169, 1997.*

* cited by examiner

*Primary Examiner*—Eugene Kim
*Assistant Examiner*—Jrszula M. Cegielnik
(74) *Attorney, Agent, or Firm*—Darby & Darby

(57) ABSTRACT

A self-play cat's cradle toy temporarily holds a string loop configuration while a user frees her hands in order to retrieve the string loop and advance it through successive string loop configurations. The toy comprises a base, first and second arms, digits supported by each of the arms, an actuator operative to move at least one arm closer to the other, and a surface provided on at least a portion of some of the digits which is configured to resist release of the string loop when the string loop is brought into a taut condition. A method for self-play cat's cradle is also provided.

21 Claims, 8 Drawing Sheets

APPARATUS FOR CAT'S CRADLE GAME

FIELD OF THE INVENTION

The present invention relates to amusement and educational devices, and more particularly concerns an apparatus and method for self-play cat's cradle.

BACKGROUND OF THE INVENTION

The game of cat's cradle is well known to many children across the globe. In that game, a loop of string is seated around a person's hand and the person manipulates the string with their fingers in order to position the string in a first configuration. A second person then takes a turn by grasping the string at strategic locations and transferring the loop to that person's hands in order to place the string in a new configuration. The loop of string is transferred back and forth through successive configurations, and that is how the game is played. Persons familiar with the cat's cradle game know that the shapes go through a progression starting with the cat's cradle and continuing to the manger, candles, cat's eye, diamonds, etc. Referring to FIGS. 10A–10E, the sequence of operations is illustrated in which a person positions the string about their hands (FIG. 10A), loops the string about each palm (FIG. 10B), moves the inner loop across each middle finger (FIGS. 10C and 10D) in order to form the cat's cradle. In FIG. 10E, a first step in transferring that shape to a second player is illustrated. The second player goes through a series of maneuvers while the first player maintains the string in a taut condition until the second user is ready to transfer the string to his or her hands.

An improvement in the art of such amusement and educational devices would be a self-play cat's cradle toy that permits a single user to manipulate a loop of string through a series of desired configurations. The present invention satisfies this and other needs.

SUMMARY OF THE INVENTION

In accordance with one aspect of the invention, a self-play cat's cradle toy is provided which can temporarily hold a string loop configuration while a user frees her hands in order to retrieve the string loop and advance it through successive string loop configurations.

A toy in accordance with this aspect of the invention comprises a base, first and second arms supported relative to the base, and a set of digits supported by each of the first and second arms. An actuator causes relative movement of at least one arm closer to the other to thereby reduce a distance between the digits of the first arm and the digits of the second arm. At this reduced distance, a string loop configuration can more readily be transferred to the toy from the user's hands. A surface is provided on at least a portion of some of the digits which is configured to resist release of the string loop when the aforementioned distance is increased and the string loop is brought into a taut condition. The taut condition better enables the user to grasp and manipulate the string loop so as to advance it to a successive configuration.

In accordance with further aspects of the invention, the digits on each arm can include a pinky digit which can be movably supported by a respective one of the first and second arms. A second actuator can be coupled to each pinky digit to effect movement of the pinky digits, if desired. Moveable pinkies can extend the range of configurations that are readily transferable to a toy constructed in accordance with the principles of this invention, but are not required.

In accordance with a different aspect of the invention, a method for self-play cat's cradle using a string loop comprises providing first and second support arms, a set of digits on each of the arms, a surface on at least a portion of the digits that is configured to resist slip-release of the string loop, with at least one of said arms being moveable to a spaced position relative to the other arm in order to bring the string loop into a taut condition when the string loop is disposed about the surfaces. The string loop is oriented in a first configuration about the user's fingers. The string loop is then disposed about the surfaces while the arms are in a proximate position relative to one another so as to transfer the first configuration of the string loop to the surfaces. At least one of said arms is moved to the spaced position until the string loop is in the taut condition in the first configuration. The string loop is then freed from the user's fingers so that the user is enabled to grasp the string loop from the surfaces while the arms are in the spaced position and advance the string loop to a second configuration about the user's fingers after the string loop has been released from the surfaces.

These and other aspects, features and advantages can be understood from the accompanying drawing figures and following written description.

BRIEF DESCRIPTION OF THE DRAWING FIGURES

FIGS. 10A–10D illustrate the movement of a loop of string through a series of maneuvers in order to position the string in a first desired configuration, while

DETAILED DESCRIPTION OF A PREFERRED EMBODIMENT

By way of overview and introduction, the present invention relates to a toy that permits self-play of the cat's cradle game using a string of loop. In general terms, the toy provides surrogate arms and hands for holding and maintaining string configurations while a user, such as a child, readies herself to retrieve the so-configured string loop from the surrogate hands in order to place the string in a next configuration. The child can then replace the string loop in whatever present configuration it may have onto the surrogate hands so that the child can once again grasp the string at specific points and remove the string from the surrogate hands while placing the string in yet another configuration. All of these steps are facilitated by a toy 100 which is arranged to permit self-play of the cat's cradle game.

Figure 1:
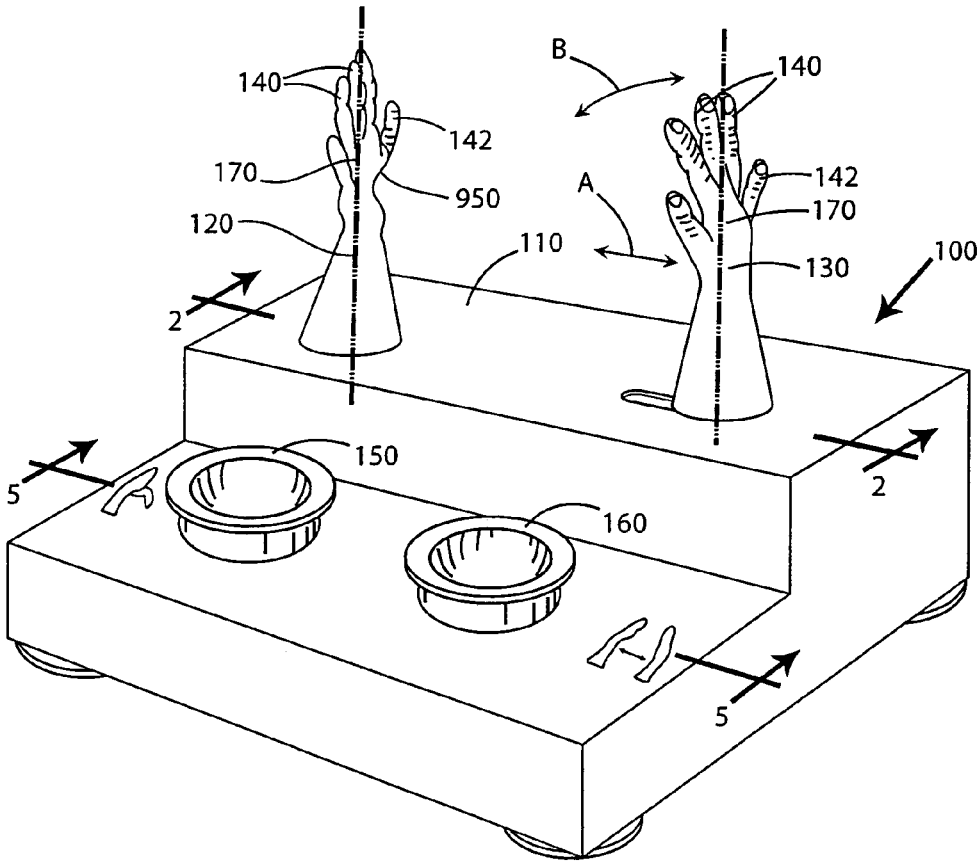
FIG. 1 is a perspective view a self-play cat's cradle toy in accordance with an embodiment of the invention.

Turning now to FIG. 1, a toy 100 in accordance with an exemplary embodiment is illustrated. The toy generally includes a base 110 having first and second surrogate arms 120 and 130, sets of digits 140 supported upon hands 170 of each of the first and second arms, and actuators 150 and 160 which effect movement of at least the second arm 130 and a pinky digit 142 in each set of digits.

In accordance with a salient aspect of the invention, at least some of the digits 140 on the hands 170 include a surface that is configured to resist release of the string loop as the second arm 130 is moved away from the first arm 120 at a first position P1 in order to bring the string loop into a taut condition. The configuration of the surface preferably comprises a frictional exterior surface such as a rubber. The frictional exterior surface, if provided, has a coefficient of static friction that is sufficient to resist slippage of the string loop from any given finger in the intended environment of the cat's cradle self-play device. The configuration of the surface also can comprise one or more protuberances 610 (see FIG. 6) which are disposed along a portion of particular digits 140 in order to catch the string and resist slippage from the digit. The protuberances can be shaped to hook the string and generally hold it in place until the string loop is removed from the hands 170 by the user. A succession of protuberances, if provided, can be very effective in preventing complete slippage from a given digit while the user manipulates the string loop in preparation for releasing the string loop from the device so that the string loop can assume a new configuration. Instead of protuberances, the digits 140 can include one or more slots (not shown) that are sized to catch the string and resist slippage from the digit in the same way. Additional surface configurations can be used to prevent string loop slippage. For example, the digits of the hands 170 can be canted outward away from one another so that slippage of the string loop is toward a space 180 between the digits on the hand (see FIG. 9). Similarly, the digits 140 can be formed in a wedge shape which is wider at the top than the bottom so that more force is required to release the string loop from a digit than to lower the string to the spaces 180 for any given spacing of the hands in which the string loop is taut. Thus, the surface configuration of the digits to resist slippage includes the orientation of at least a portion of the digits. A given construction of the self-play cat's cradle device can include a surface that is configured with a frictional outer surface, protuberances, slots, hooks, a prescribed orientation, or a combination of these features.

Note that the pinky digit 142 preferably is configured on a surface opposite to that of the other digits in view of the way in which the pinky is used in game play as compared to the other digits of one's hand.

As illustrated in FIG. 1, the arms 120, 130 are supported relative to the base 110. More particularly, the first arm 120 can be rigidly supported in the first position P1 relative to the base. Meanwhile, the second arm 130 can be moveably supported relative to the base, such as along the direction of arrow A. In this way, the second arm 130 can be moved toward the first position P1 where the first arm is located, and away from that first position (e.g., toward position P2). Such movement of the second arm permits a string loop of prescribed length to be brought into a taut condition when positioned about the sets of digit 140 of the first and second arms.

When using the self-play cat's cradle toy 100, it is anticipated that the child will have the string loop (not shown) wrapped around her hands until such time that the string loop is ready for transfer to the first and second sets of digits 140. Because the child's hands are occupied, the second arm is preferably moved towards the first position P1 in response to an actuator that can be readily accessed by the user even though the user's hands may still be holding a particular string configuration. In the embodiment of FIG. 1, the actuator 160 is positioned along the base 110 for actuation by an elbow of the user, while the hand of the user remains able to position the string loop upon the digits 140. Preferably, the actuator 160 is resiliently biased to an upward position, and coupled to the second arm 130 to effect movement of the second arm toward the first position P1 in response to an actuation (e.g., a press) of the actuator 160.

Figure 2:
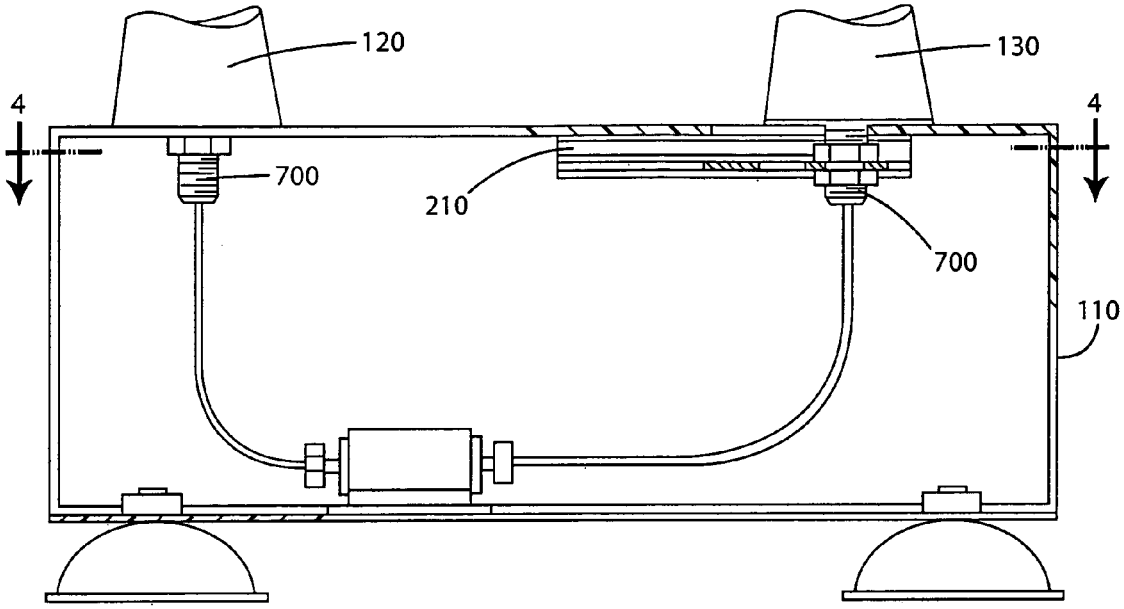
FIG. 2 is a cross sectional view taken along lines 2—2 of FIG. 1.

With reference to FIG. 2, the base 110 is shown in cross-section to illustrate a track 210 along which the arm 130 can move. More particularly, the second arm 130 moves toward position P1 by slideable movement within the track 210, in this embodiment. It should be understood, that other directional movements are within the scope of the present invention such as pivotal or arcuate movement of the second arm. What is important to the invention is that the space 180 between the digits 140 on the first and second arms 120, 130 be variable by the user in order to introduce slack and restore tautness in the string loop when positioned upon the surrogate arms 120, 130.

Figure 7:
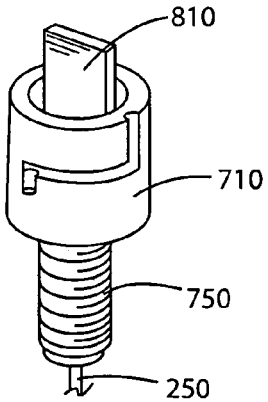
FIG. 7 is a detailed view of a slideable post that engages the arms of the embodiment of FIG. 1.

The second arm 130 connects to the track 210 via a slideable post 700, which is described in further detail in reference to FIG. 7. The slideable post 700 is driven by a transmission that is responsive to actuation of the actuator 160, as described next with reference to FIGS. 3 and 4.

Figure 3:
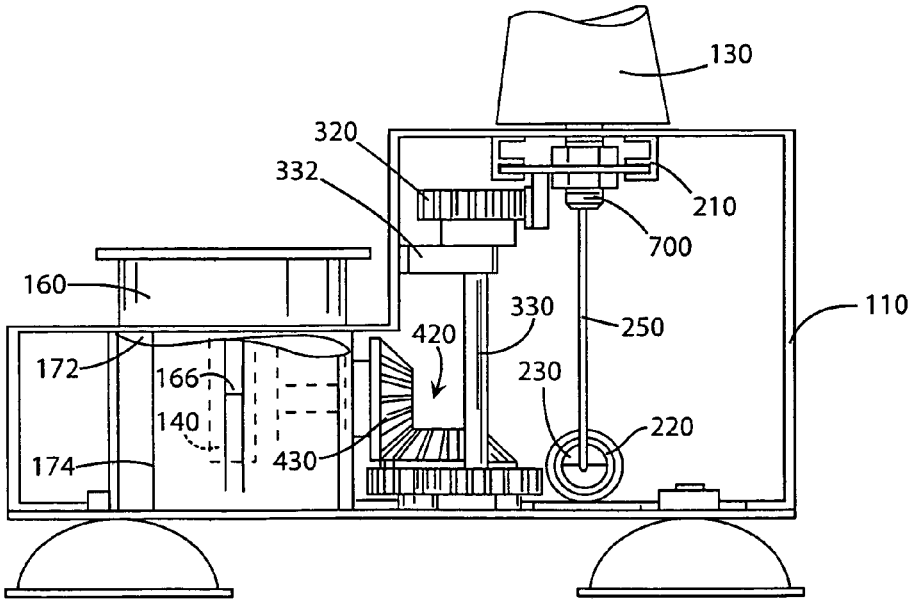
FIG. 3 is a cross sectional view taken along line 3—3 of FIG. 4.
Figure 4:
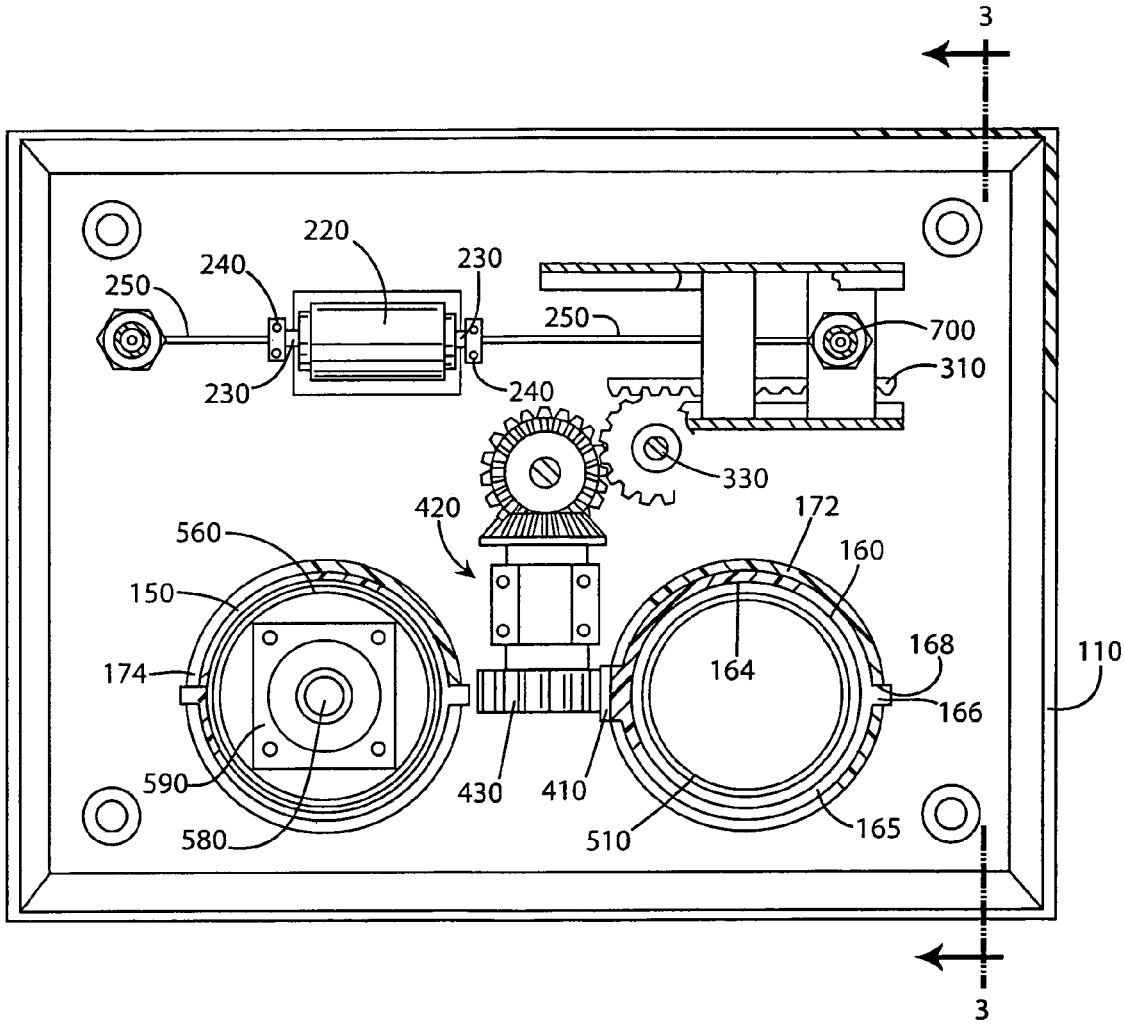
FIG. 4 is a cross sectional view taken along line 4—4 of FIG. 2.

As shown in FIGS. 3 and 4, the slideable post 700 is connected to a rack 310. A pinion 320 rotates about a shaft 330 and while rotating engages the rack and causes the slideable post and hence the second arm 130 to travel along the line indicated by arrow A. The pinion is driven by a transmission that is coupled to the actuator 160. In particular, the actuator includes a drive gear surface 410 which has a range of motion that is coincident with the movement of the actuator 160. The drive gear engages a transmission 420 which includes a sun gear and various further gears which couple movement of the drive gear 410 to the pinion 320. In the illustrated embodiment, a transmission 420 imparts a mechanical advantage to the movement of the second arm 130 as compared to the movement of the actuator 160. In other words, a sliding movement in the direction of arrow A exceeds the travel of the actuator 160 when the transmission gears are arranged appropriately. In an alternative arrangement, the movement of the second arm 130 can be disadvantaged as compared to the range of motion of the actuator 160, for example, when it is desired to have less movement of the second arm 130 for a given amount of movement of the actuator 160. Optionally, gear shifting can be provided in the transmission 420 to change the degree of mechanical advantage or disadvantage as between the actuator 160 and the movement of the second arm 130.

With reference again to FIG. 3, the pinion 320 can be supported by a collar 332 which is attached to the base 110, and optionally a spacer 340 can be provided to separate the pinion from the collar 332.

Figure 5A:
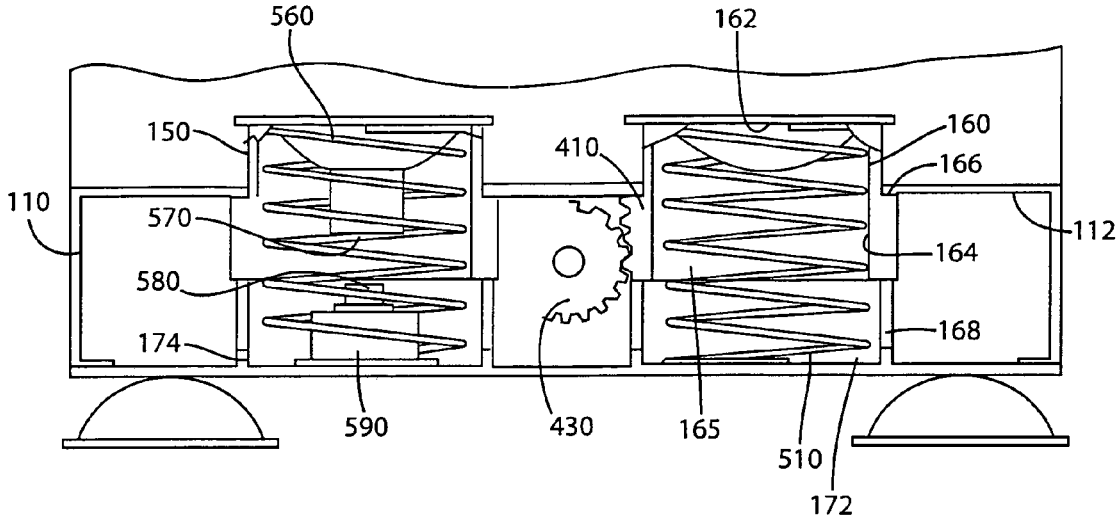
FIGS. 5A and 5B are cross sectional views taken along line 5—5 of FIG. 1 and illustrate actuators in their extended and retracted positions, respectively.
Figure 5B:
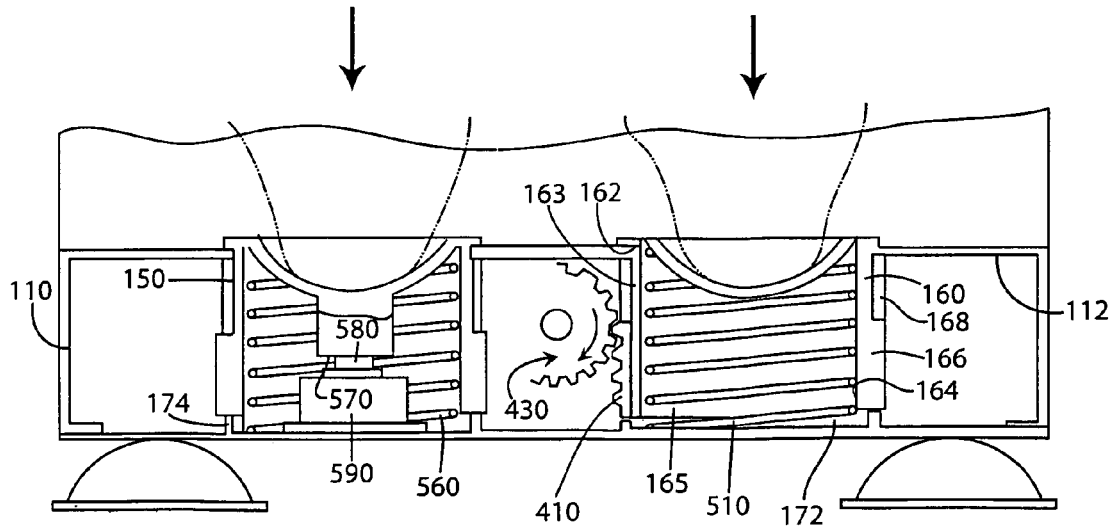

Turning briefly to FIGS. 5A and 5B, movement of the actuator 160 is described. In FIG. 5A, the actuator 160 is shown in an extended, rest position. In that position, a bias such as a spring 510 urges against a bearing surface 162 on the underside of the actuator. The drive gear surface 410 is shown as a series of teeth on a side surface 163 of the actuator. Within a central cavity 164 of the actuator, the spring 510 is seated. Preferably, the actuator 160 includes a protuberance 166, which rides in slot 168 in support of cylinder 172. This protuberance, balanced by drive gear surface 410, rides in a similar slot on the opposite side of the support cylinder. radial flange 166 which abuts an interior top surface 112 of the base when the actuator is in its fully extended position. On the other hand, the side walls 165 are preferably sized so as to permit travel of the actuator from its extended position (as shown in FIG. 5A) downwardly to a retracted position as shown in FIG. 5B. During the course of travel of the actuator, the drive gear surface 410 engages the transmission 420, and more particularly, a sun gear 430 to cause motion of the sun gear which is transferred through the transmission to the pinion 320. Thus, in response to the downward motion of the actuator 160, the sun gear 430 rotates in a clockwise direction as shown in FIG. 5B. When downward force of an elbow or other source of pressure is released from the actuator, the actuator resiliently returns to its extended position in response to the restoring force of the bias, which in the illustrated embodiment is the spring 510.

Figure 8:
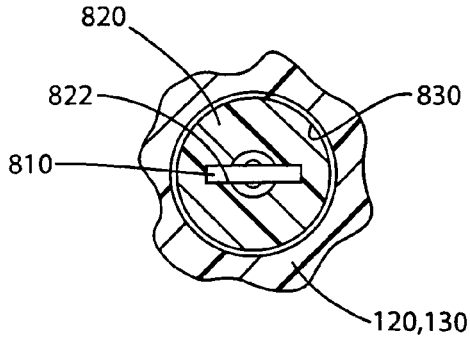
FIG. 8 is a cross sectional view taken along line 8—8 of FIG. 6, and shows a keyed engagement between the slideable post and a linkage permitting movement of a pinky digit on the arms.
Figure 6:
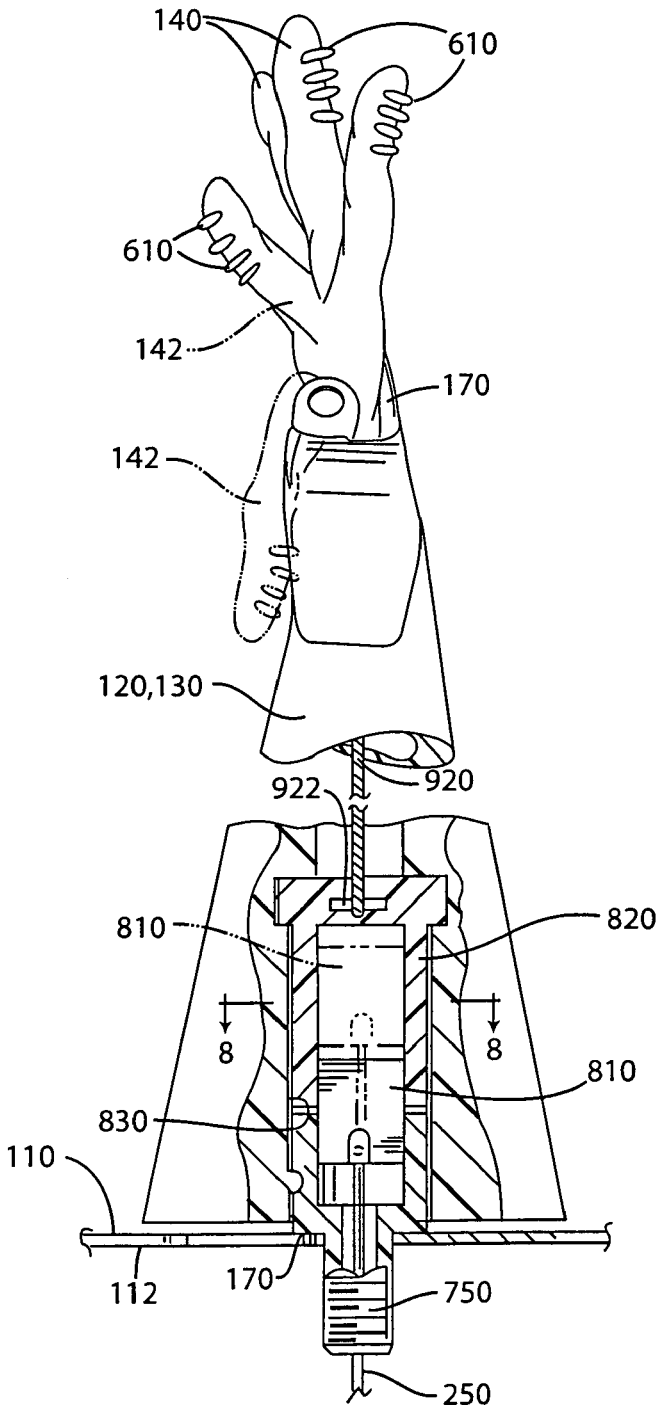
FIG. 6 is a detailed view, partially in section, of an arm that is supported relative to the base of FIG. 1.

As shown in FIGS. 6, 7 and 8, the slideable post extends exteriorly of the base 110 and includes a locking mechanism 710 which permits the arm 130 to be positioned about the slideable post and be locked into place. In one form, the locking mechanism comprises a bayonet fitting, though persons of skill in the art will appreciate that the arm 130 can be seated on the slideable post 700 in a number of ways including a simple friction fit. At least a portion of the slideable post is accessible exteriorly of the base 110 for attachment of the arm 130 thereto. In like manner, the arm 120 is attached to the base by seating upon a suitably configured post 750. The post 750 need not slide because a full range of motion suitable for introducing slack or tautness in a string loop can be achieved by moving only one of the two arms 120, 130. In alternative configurations, the post 750 can be moveably mounted within the base such as within a track 210 as previously described. In the illustrated embodiment, the post 750 and the arm 120 are rigidly positioned relative to the base. The posts 700, 750 thus both include an exterior engagement surface 720 which permits the arm to be secured in a rigid, upright position, and to be removably supported relative to the base in order to permit compact storage of the device 100.

In an alternative arrangement, the arms 120, 130 can be pivotedly supported relative to the base such that they fold down to a low profile configuration, and are moveable into a locked, upright position for game play. Like the illustrated embodiment, this alternative embodiment permits compact storage of the device and further permits the device to be contained within a product box that is not substantially larger than the base itself.

In accordance with the preferred embodiment, the pinky digit 142 of each hand 170 is moveably supported relative to the other digits of each hand. The pinky digits 142 are preferably moveable in order to more readily permit the device 100 to transfer a progression of string loop shapes that includes shapes which require a bent pinky (e.g., the cat's cradle). In order to effect movement of the pinky digit 142, a second actuator 150 is provided on the base 110. The second actuator is coupled to each pinky digit in order to effect movement of the pinky digit. Preferably, the second actuator is positioned proximate to either of the first or the second arm, and can be an elbow actuated switch.

In the illustrated embodiment, the actuator 150 turns on a motor which alternatively spins in a clockwise and then counterclockwise direction, with alternate actuations of the motor. The motor 220 includes a shaft 230 which includes a coupling 240 to a flexible linkage 250. The motor rotates the shaft 230 and hence the coupling 240 to cause a corresponding rotation at a distal end of the flexible linkage 250. The linkage extends up through the posts 700, 750 to rotate an impeller 810 (see FIGS. 7 and 8).

The drive, which in the illustrated embodiment comprises the motor 220, is actuated by the second actuator 150 to move the pinky digit 142 between an upright position in which the pinky is generally parallel to the other digits 140 in the hand and a relaxed position in which the pinky digit 142 is generally anti-parallel (that is, in a downward position relative to the other digits 140 in the hand 170). The linkage 250 is preferably a flexible wire that faithfully transmits torque from a proximal end connected to the coupling to a distal end connected to the impeller 810. The flexible linkage is thus rotatable in response to rotation of the motor shaft 230 in order to effect movement of the pinky digit between the upright and relaxed positions.

Figure 9:
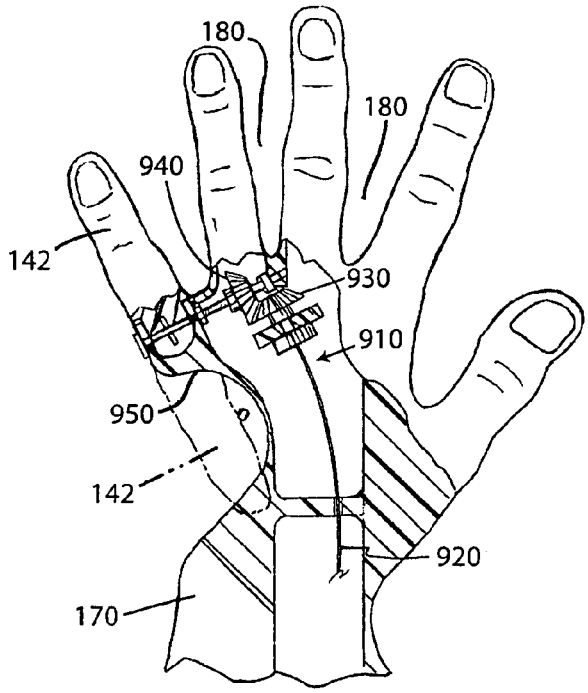
FIG. 9 is a detailed plan view of one of the hands disposed upon one of the arms, shown partially in section to illustrate a transmission for driving the pinky digit between an upright and relaxed position.

As shown in FIGS. 6 and 9, showing upright, and relaxed pinky positions, and cutaway view of FIG. 8. In FIG. 9, a pinky drive coupling 910 includes a flexible linkage 920 which is connected to a drive gear 930 that transmits the rotational force of the motor 220 to the pinky digit 142. More particularly, a gear train 940 moved the pinky between the upright and relaxed positions in response to rotation of the drive gear 930 in a first or second direction. The linkage 920 is rotated by the impeller 810 through a mating of a journaled receptor 820 that sits in the cavity 830 of the arms 120, 130. In particular, the receptor 820 has a slot 822 sized to receive the impeller 810, and transfers torque to the flexible pinky linkage 920 via a coupling 922.

In FIGS. 5A and 5B, the second actuator 150 has a bias 560 which normally maintains the second actuator in an upright position. The actuator includes a contact surface 570 which is moveable into contact with a switch 580 which is supported by a support cylinder 174, similar to cylinder 172. In FIG. 5A, the second actuator 150 is shown in the upright position with the bias 560 in a generally, unstressed state bearing against an underside of the actuator 150. In FIG. 5B, the second actuator has moved to its retracted position in which the contact surface 570 is pressing upon the switch 580, causing the motor to rotate in a prescribed direction and thereby move the pinky digit 142 from its present position to a different position. More specifically, if the pinky were in an upright position then it is moved to the relaxed position and if the pinky digit were in the relaxed position then it is moved to the upright position. Toggle circuitry 590 can be associated with the switch 580 to reverse the motor direction with each successive actuation. In lieu of circuitry 590, a mechanical arrangement can be provided, as can be appreciated by persons of skill in the art, so that the electrical contacts to the DC motor 220 are alternately reversed with each depression of the switch 580. This can be done in a conventional way by introducing a rotatable cam between the motor's electrical supply leads and the motor's source of power. The cam surface is journaled in response to pressing of the second actuator 150. The so-journaled cam connects the leads of the motor 220 to its source of power in a first orientation. With each successive actuation of the second actuator 150, the cam is journaled further to cause the motor's leads to be reversibly connected to the source of power. The reversed electrical connection will cause the motor to spin in an opposite way with each actuation.

As understood in the art, a clutch (not shown) is preferably provided to permit the motor to spin even after the pinky digit 142 assumes it upright or relaxed position.

With further reference to FIG. 6, the impeller 810 and the flexible linkage 250 can slide relative to the slideable post 700 when the arm 120 is moved so that slack in the linkage is accommodated.

Figure 9A:
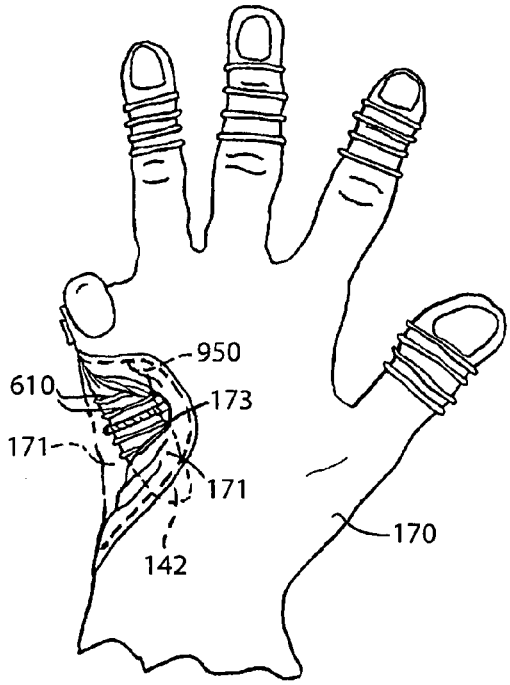
FIG. 9A is a plan view of one of the hands showing an optional flexible cover overlying a slot that may be provided in the hand.
Figure 10A:
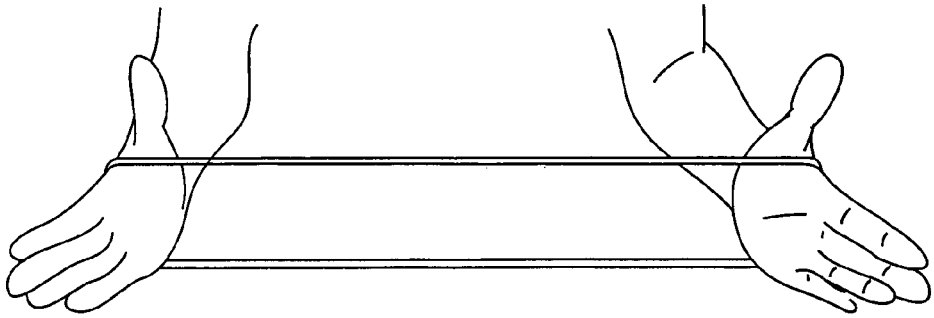
Figure 10B:
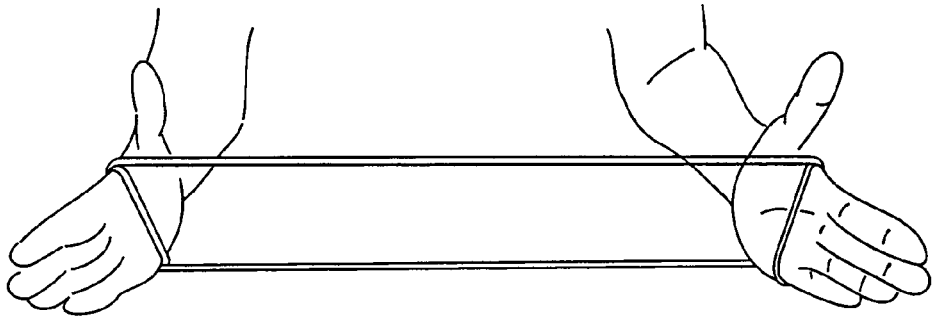
Figure 10C:
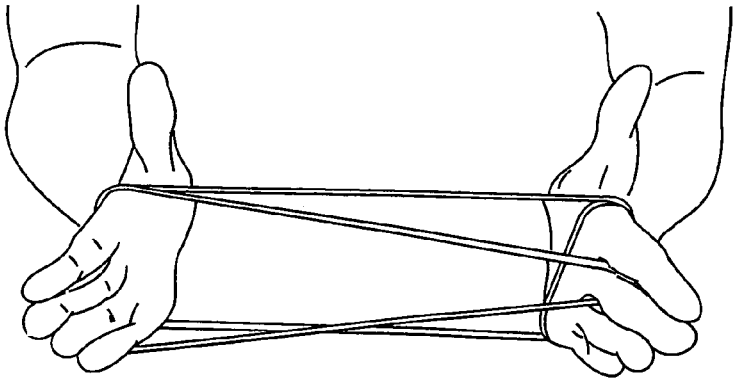
Figure 10D:
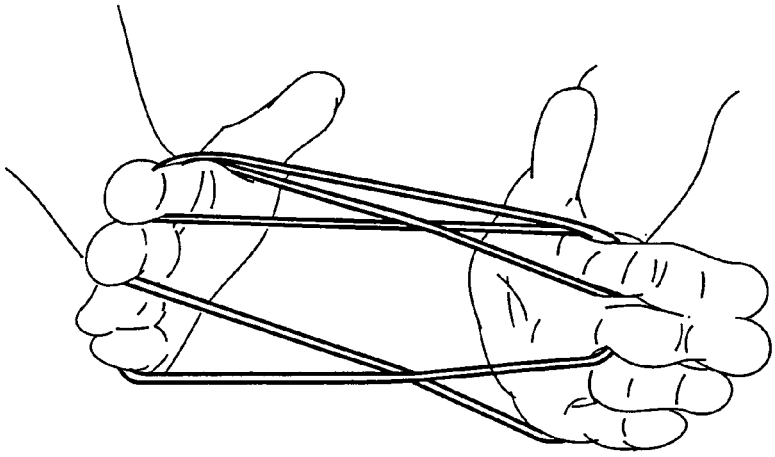
Figure 10E:
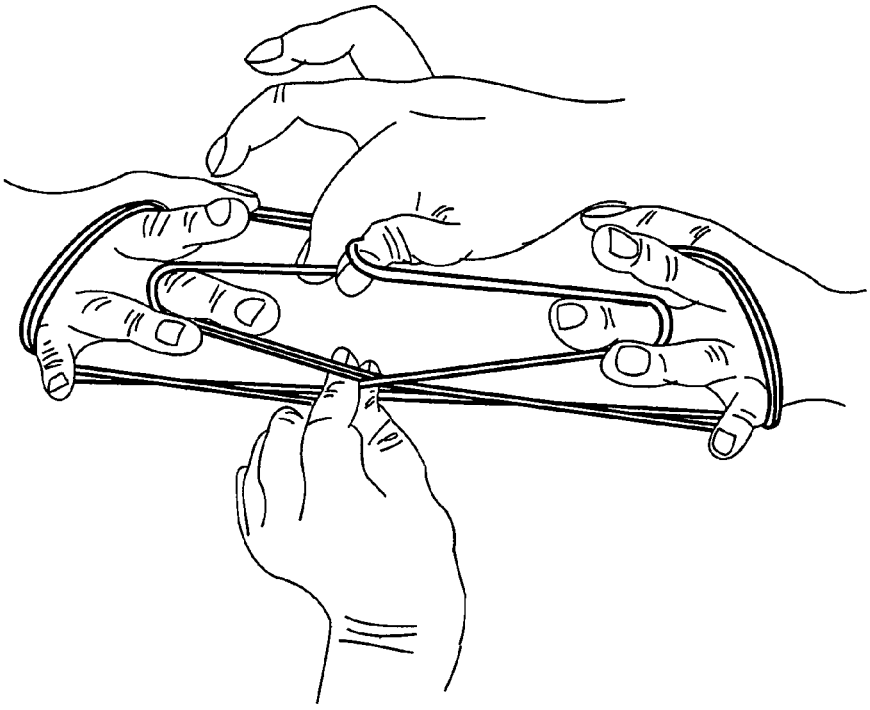
FIG. 10E illustrates a first maneuver in the transfer of the string to a second player's hands, in accordance with a conventional play of cat's cradle.

With reference now to FIGS. 9 and 9A, the hand 170 optionally includes a slot 950 generally below the pinky digit 142 when the pinky is in the upright position. The slot in the hand 170 can facilitate transfer of particular string configurations when the user's hands are positioned around the two hands 170. For certain string configurations such as the cat's cradle, the user's pinkies are holding the string and it is desirable to have a direct line of sight between the user's pinkies prior to transferring the string configuration to the device 100. The slot 950 facilitates this, and the second actuator 150 can then be used to move the pinky digit 142 downward into the relaxed position. In that position, the slot 950 is preferably closed (see phantom lines) and the string configuration held by the user now has the pinky digit 142 disposed so as to catch the string when released by the user. Optionally, as shown in FIG. 9A, a cover 171 made of a flexible material such as a portion of a nylon stocking is disposed in overlying relationship to the slot (e.g., in the form of a glove portion, a band about the hand 170, or a swatch affixed to the hand) to obscure the slot from view. If such a cover is provided, it is preferably configured to flex in response to any compression force imparted upon the cover 171 by the string loop 173, in the event that the string loop is pressed against the cover, as illustrated (e.g., while the string loop is in the taut condition and a string configuration transfer involving the use of pinkies is being performed).

While the invention has been described in connection with certain embodiments thereof, it embraces insubstantial variations that would be understood by persons of ordinary skill in the art, and thus the invention is not limited by the foregoing description but rather is defined by the recitations in the following claims and equivalents thereof.

What is claimed is:

1. A self-play cat's cradle toy that permits a single user as a first player to manipulate a string loop, comprising:

a base;

a first arm supported in a first position relative to the base;

a second arm moveably supported relative to the base;

a set of digits supported by each of the first and second arms;

a resiliently-biased, manual actuator positioned along the base and physically coupled to the second arm to effect movement of the second arm toward the first position in response to pressure on the actuator, the manual actuator resiliently returning to a rest position in response to the restoring force of the bias; and a surface of at least a portion of the digits in the set of digits being configured to resist release of the string loop as the second arm is moved away from the first position in order to bring the string loop into a taut condition, wherein the first and second arms are surrogates for a second player; and wherein the base, arms, actuator and surface cooperate as a device to permit the single user to self-play cat's cradle.

2. The toy of claim 1, wherein at least one of the first and second arms is removably supported relative to the base.

3. The toy of claim 1, wherein at least one of the first arm and second arms is pivotally supported relative to the base.

4. The toy of claim 1, wherein the actuator has a range of motion responsive to the actuation by a user, and wherein the movement of the second arm is translational movement and is transmissioned-up to have a mechanical advantage over the range.

5. The toy of claim 1, wherein the actuator is positioned along the base for actuation by an elbow of a user while the hand of the user positions the string loop upon the surfaces.

6. The toy of claim 1, further comprising a slideable post accessible exteriorly of the base.

7. The toy of claim 6, wherein the slideable post includes a rack, the rack being coupled to the actuator for slideable movement of the rack in response to movement of the actuator.

8. The toy of claim 6, wherein the slideable post has an engagement surface and wherein the second arm is selectively secureable in a rigid, upright position relative to the engagement surface.

9. The toy of claim 6, wherein the slideable post has a keyed impeller.

10. The toy of claim 7, further comprising a pinion engaging the rack, and a transmission operatively connected to the pinion to rotate the pinion in response to movement of the actuator.

11. The toy of claim 10, further comprising a plunger biased toward an extended position and operatively associated with the actuator to resiliently urge the actuator to the extended position against the restoring force of the bias, the plunger being moveable against the restoring force to move the transmission.

12. The toy of claim 1, wherein each set of digits includes a pinky digit, and wherein each pinky digit is movably supported by a respective one of the first and second arms.

13. The toy of claim 12, further comprising a second actuator coupled to each pinky digit to effect movement of each pinky digit.

14. The toy of claim 13, wherein the second actuator is positioned proximate to at least one of the first and second arms.

15. The toy of claim 13, further comprising a drive actuated by the second actuator to move the pinky digit between an upright position in which the pinky digit is generally parallel to the other digits in the set of digits and relaxed position in which the pinky digit is generally anti-parallel to the other digits in the set of digits.

16. The toy of claim 15, wherein the drive is a motor having a rotatable shaft.

17. The toy of claim 15, further comprising a linkage coupling the rotatable shaft to each moveable pinky digit to effect movement of the pinky digit between the upright and relaxed positions.

18. The toy of claim 15, wherein the second actuator toggles the drive so as to move each pinky digit from the upright position to the relaxed position or from the relaxed position to the upright position with each actuation of the second actuator.

19. The toy of claim 15, wherein the arm has a hand from which the set of digits are supported, the hand has an open slot when the pinky digit is in the upright position and a closed slot when the pinky digit is in the relaxed position.

20. The toy of claim 19, further comprising a flexible cover disposed so as to overlie the slot yet flex in response to a compression force by the string loop when pressed against the cover while the string loop is in the taut condition.

21. The toy of claim 1, further comprising a slideable post accessible exteriorly of the base and having an impeller, wherein the first and second arms include a pinky-drive coupling rotatably supported within each said arm and engageable with the impeller.

* * * * *